US007562665B2

(12) United States Patent
Saito et al.

(10) Patent No.: US 7,562,665 B2
(45) Date of Patent: Jul. 21, 2009

(54) CLEANING DEVICE FOR A HAIR REMOVING APPARATUS AND METHOD OF CLEANING THE SAME

(75) Inventors: Atsuhiro Saito, Hikone (JP); Hiroyuki Kameoka, Hikone (JP); Jyuzaemon Iwasaki, Nagahama (JP); Fumio Taniguchi, Hikone (JP); Yasuo Ibuki, Hikone (JP); Hiroshi Shigeta, Fujiidera (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 665 days.

(21) Appl. No.: 11/057,235

(22) Filed: Feb. 15, 2005

(65) Prior Publication Data

US 2005/0189003 A1 Sep. 1, 2005

(30) Foreign Application Priority Data

Feb. 26, 2004 (JP) ..... 2004-052310

(51) Int. Cl.
*B08B 3/00* (2006.01)

(52) U.S. Cl. ..... 134/111; 134/109; 134/110; 134/186; 30/537; 30/541; 206/207; 206/208; 206/351

(58) Field of Classification Search ..... None
See application file for complete search history.

(56) References Cited

U.S. PATENT DOCUMENTS 5,711,328 A 1/1998 Braun
6,132,600 A * 10/2000 Marchesseault et al. ..... 210/143
2002/0069902 A1 6/2002 Hoser et al.

FOREIGN PATENT DOCUMENTS

EP 0 664 973 A1 8/1995
EP 1 440 628 A1 7/2004

(Continued)

OTHER PUBLICATIONS

European Patent Office Search Report mailed on Apr. 29, 2005.

(Continued)

*Primary Examiner*—Michael Kornakov
*Assistant Examiner*—Eric Golightly
(74) *Attorney, Agent, or Firm*—Cheng Law Group PLLC

(57) ABSTRACT

A cleaning device utilizes a cleaning liquid composed of a solute dissolved in a solution for cleaning an operator head of a hair removing apparatus. The device includes a housing configured to hold the hair removing apparatus, a basin mounted in the housing for receiving therein the operator head, and a tank storing the solution or the liquid. A circulator is provided to circulate the cleaning liquid between the tank and the basin. The device includes a container which is configured to hold the solute and is formed separately from the tank. The container is disposed in a circulation path between the basin and the tank in order to replenish the solute into the circulating solution or the liquid. Thus, the solute can be constantly supplied to the solution or the cleaning liquid for maintaining the cleaning effect over a prolonged period of use and for easy replenishment of the solute, eliminating the necessity of replacing the whole cleaning liquid.

7 Claims, 8 Drawing Sheets

FOREIGN PATENT DOCUMENTS

| | | | |
|---|---|---|---|
| JP | 06-254518 | A | 9/1994 |
| JP | 07-051472 | A | 2/1995 |
| JP | 07-236514 | A | 9/1995 |
| JP | 2000-093668 | A | 4/2000 |
| JP | 2003-506122 | A | 2/2003 |

OTHER PUBLICATIONS

Office Action from Japan Patent Office "Notification of Reasons for Refusal" with English Translation, App. No. 2004-052310, mailed Jul. 17, 2007 (4 pages total).

* cited by examiner

CLEANING DEVICE FOR A HAIR REMOVING APPARATUS AND METHOD OF CLEANING THE SAME

FIELD OF THE INVENTION

The present invention is directed to a cleaning device for a hair removing apparatus, particularly a dry shaver with the use of a cleaning liquid, and also a cleaning method for the apparatus.

DESCRIPTION OF THE PRIOR ART

U.S. Pat. No. 5,711,328 A discloses a cleaning device for a dry shaver. The device is formed with a basin for receiving therein a shaver head of the shaver, and a tank storing a volume of a cleaning liquid. A pump is disposed in the liquid supply channel in order to circulate the liquid between the tank and the basin for cleaning the shaver head, i.e., cutters and the associated parts. In order to improve the cleaning effect with the use of such device, it is desirable that the cleaning liquid includes a solute such as a surfactant, a sanitizer, antifoaming agent, or a lubricant dissolved into a solvent such as water or aqueous solution of alcohol. In view of that such solute is likely to diminish during the repeated cleaning operation and therefore make the whole cleaning liquid less effective, the liquid solution has to be replaced with a fresh one for keeping the intended cleaning effect over a long period of use. For this purpose, it could be proposed to make the tank itself as a replacement cartridge for easy replacement of the cleaning liquid. However, because of the tank is configured to store a relatively large volume of the cleaning liquid, the replacement tank has to be bulky and therefore be inconvenient for maintenance of the device.

DISCLOSURE OF THE INVENTION

In view of the above insufficiency, the present invention has been accomplished to provide a cleaning device which is capable of assuring a prolonged cleaning effect with easy maintenance. The device in accordance with the present invention includes a housing configured to hold a hair removing apparatus, a basin mounted in the housing for receiving therein an operator head of the apparatus, and a tank mounted on the housing to store a solution into which a solute is dissolved to give the cleaning liquid. A circulator is provided to supply the cleaning liquid into the basin from the tank for cleaning the operator head and to recover the cleaning liquid from the basin back into the tank. The feature of the present invention resides in that the device includes a container which is configured to hold the solute and is formed separately from the tank to be mounted to the housing, and that the container is disposed in a circulation path between the basin and the tank in order to replenish the solute into the circulating solution or the liquid. When the cleaning liquid becomes short of the solute, it is easy to maintain the cleaning effect simply by replenishing the solute in the container for maintaining the cleaning effect, thereby eliminating the necessity of replacing the whole cleaning liquid. Thus, the solute can be constantly supplied to the solution or the cleaning liquid for maintaining the cleaning effect over a prolonged time.

Preferably, the container is made detachable to the housing to assure easy supplement of the solute or to serve as a replacement package for easy maintenance. Accordingly, it is possible to reduce the size of the replacement package in comparison with the tank for easy maintenance of the device.

The container is preferred to be disposed in a recovery path from the basin to the tank to replenish the solute in the solution recovered from the basin to the tank. In this instance, the container may be provided with a filter for trapping dirt included in the cleaning liquid being recovered from the basin to the tank. Thus, the filter can be replaced together with the solute so as to keep the filtering effect optimum over a long period of use. The filter may be fabricated from fibers and incorporated in the container. Further, the filter may be impregnated with the solute to give a dual function of trapping the dirt and replenishing the solute.

Preferably, the solvent includes at least one selected from a group consisting of water and alcohol, while the solute includes at least one selected from a group consisting of a surfactant, a sanitizer, antifoaming agent, and a lubricant.

Further, the circulator is preferred to include a pump for feeding said cleaning liquid and/or the outside are into the tank from the basin, while the tank is composed of a hermetically sealed pressure chamber and an open-air liquid dispensing chamber. The pressure chamber is configured to have an inlet for introducing the liquid and/or the air from the basin, while the liquid dispensing chamber is configured to have an outlet for dispensing the liquid out of the tank into the basin. The pressure chamber and the liquid chamber communicates with each other through a bottom channel at a level lower than the outlet such that the air introduced into the pressure chamber is accumulated therein to rise the liquid level of the liquid dispensing chamber above the outlet for feeding the liquid out of the tank into the basin. Based upon this arrangement, the tank can be easily designed to recover the whole the cleaning liquid from the basin, while not dispensing the liquid out of the tank by locating the outlet at a suitable level.

The present invention further discloses a cleaning method which includes the steps of placing an operator head of the hair removing apparatus into the basin; circulating the cleaning liquid between the tank and the basin to feed the liquid to the basin for cleaning said operator head and to recover the liquid from the basin into said tank, and replenishing the solute into the liquid circulating between the basin and the tank. With this method, it is made easy to keep the cleaning liquid effective over the long-period of use simply by adding the solute, without replacing the whole liquid with a fresh one, which is convenient for maintenance and also for avoiding unnecessary disposal of the liquid.

These and still other advantageous features of the present invention will become more apparent from the following detailed description of the preferred embodiment when taken in conjunction with the attached drawings.

BEST MODE FOR CARRYING OUT THE INVENTION

Figure 1:
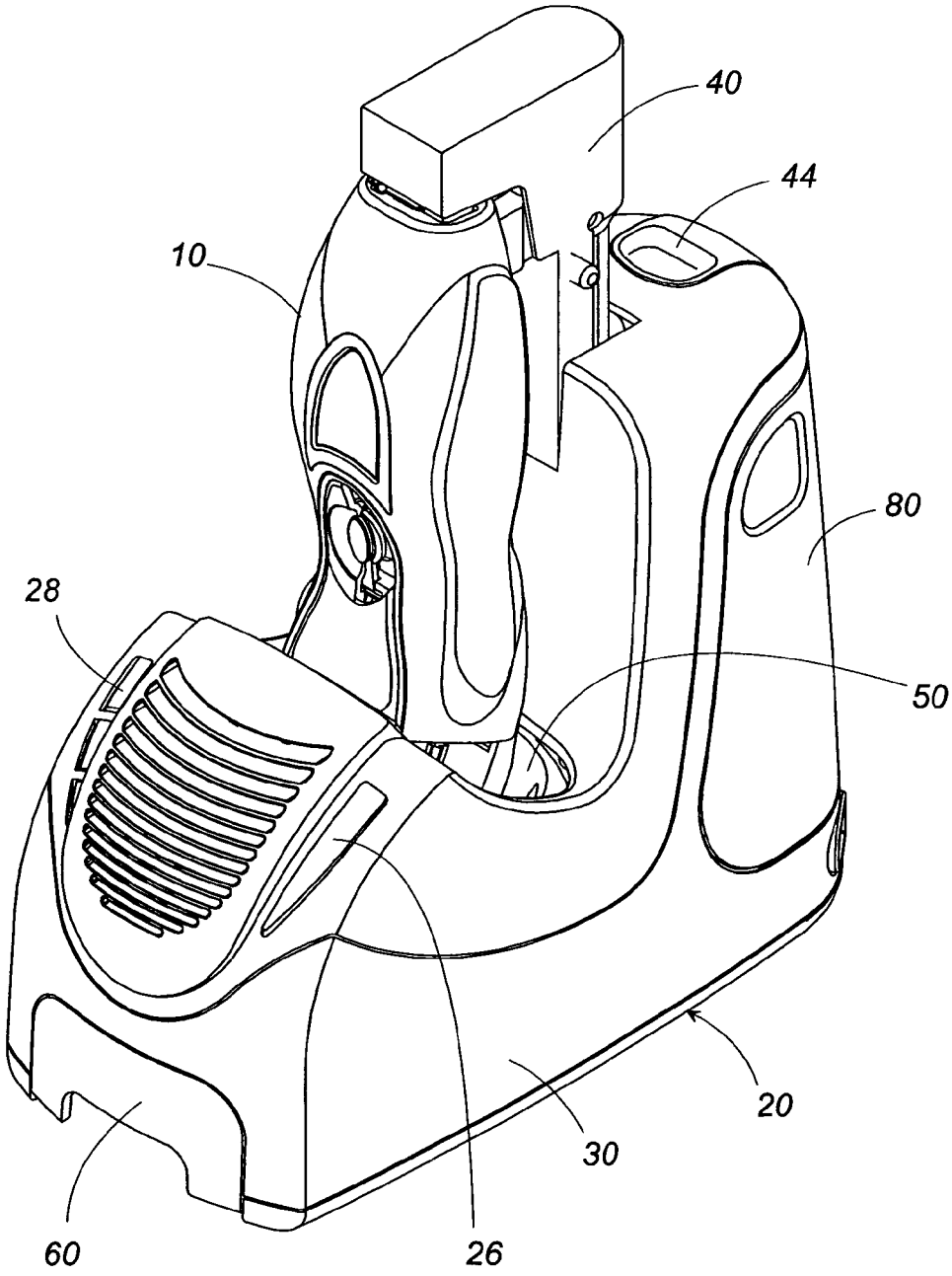
FIG. 1 is a perspective view of a cleaning device in accordance with a preferred embodiment of the present invention.
Figure 2:
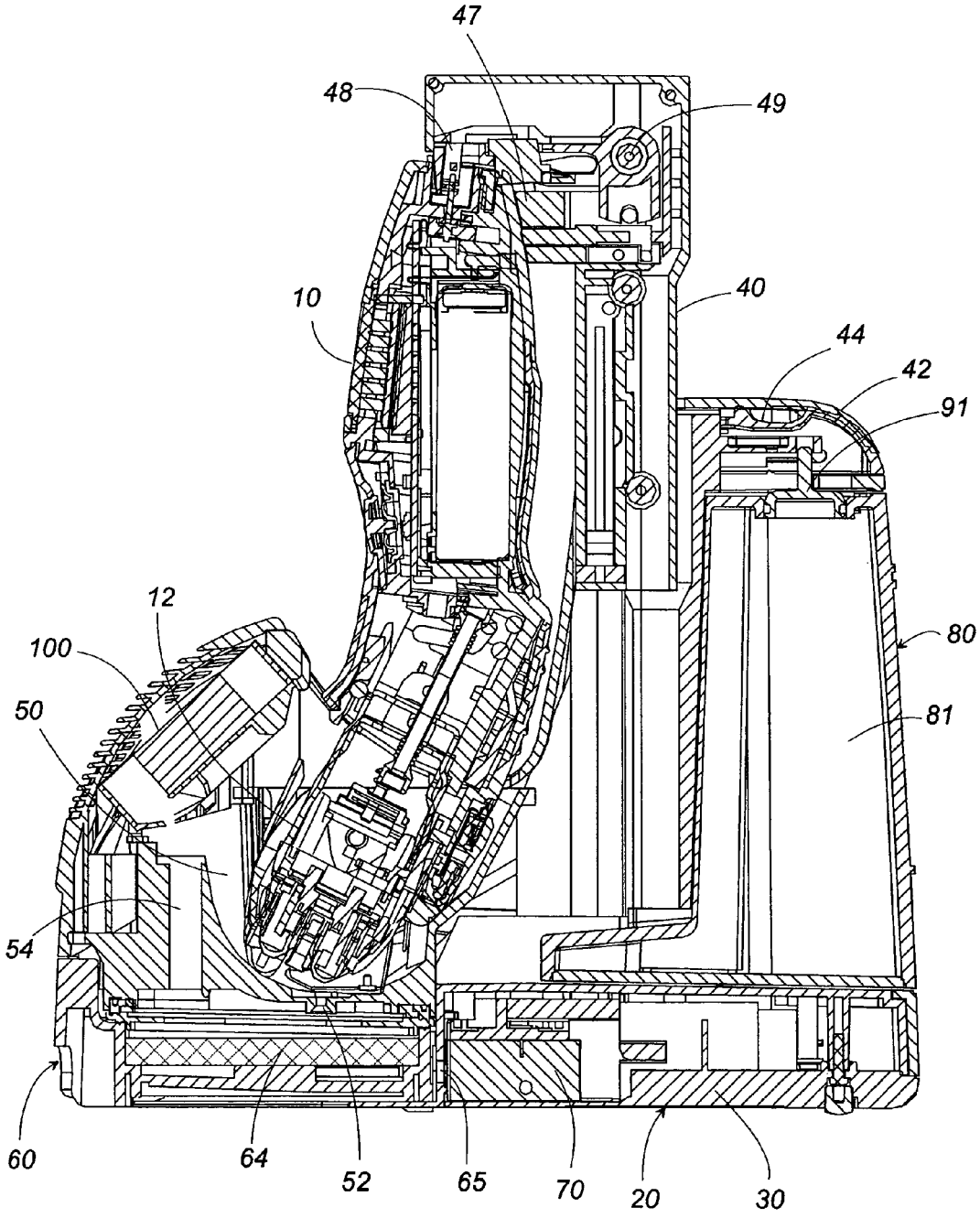
FIG. 2 is a vertical section of the cleaning device.
Figure 3:
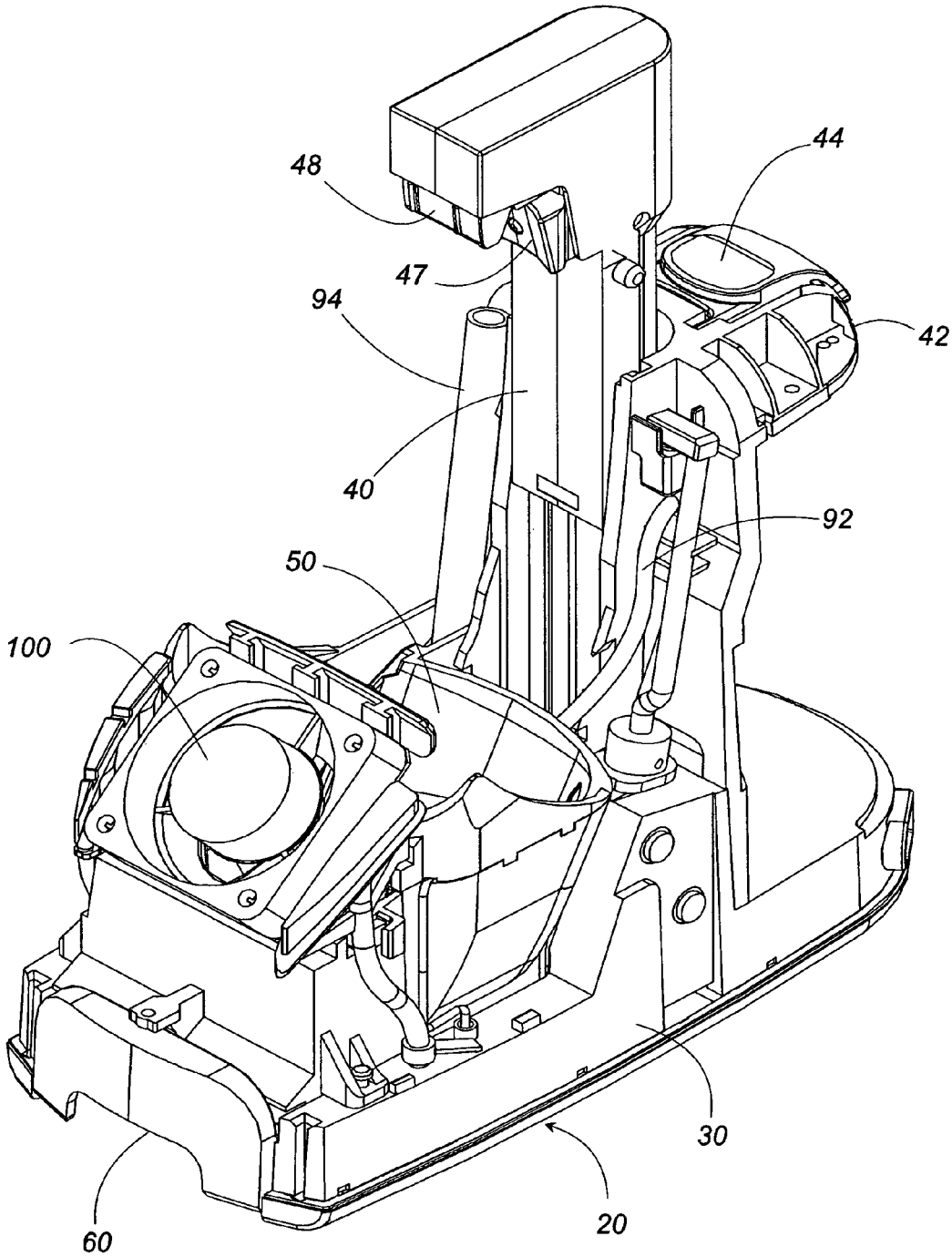
FIG. 3 is a perspective view of the cleaning device with a portion thereof cut away.

Referring now to FIGS. 1 to 3, there is shown a cleaning device for cleaning a hair removing apparatus, for example, a dry shaver 10 or epilator with the use of a cleaning liquid. The cleaning liquid is composed of a solution, for example, water and a solute dissolved in the solution for enhancing the cleaning effect. Typical solute includes one or more of a surfactant, a sanitizer, antifoaming agent, and a lubricant. Most preferably, the solute includes all of these components. The solution may be other than the water, for example, alcohol or aqueous solution of alcohol.

The device has a housing 20 with a base 30 and a stand 40 upstanding from the base to hold the shaver 10 upside down. Formed at the front end of the base 30 is a basin 50 which is configured to receive an operator head, i.e., a shaver head 12 of the shaver 10. The cleaning liquid is stored in a tank 80 detachably mounted to the rear end of the housing 20 behind the stand 40 and is connected to the basin 50 to supply the cleaning liquid into the basin 50 for cleaning the shaver head 12 and to recover the liquid therefrom. The device includes a pump 70 which is cooperative with the tank 80 to define a circulator responsible for circulating the cleaning liquid between the tank 80 and the basin 50. The pump 70 is controlled to continue the cleaning operation for a predetermined period. Thereafter, a control is made to recover the liquid from the basin 50 into the tank 80, details of which will be discussed later. Upon recovery of the liquid into the tank, a fan 100 is actuated to produce a forced air flow over the head 12 for drying the same. Initially, the tank 80 is filled with the solution into which the solute is replenished while the solution is forced to circulate between the basin 50 and the tank 80.

Figure 4:
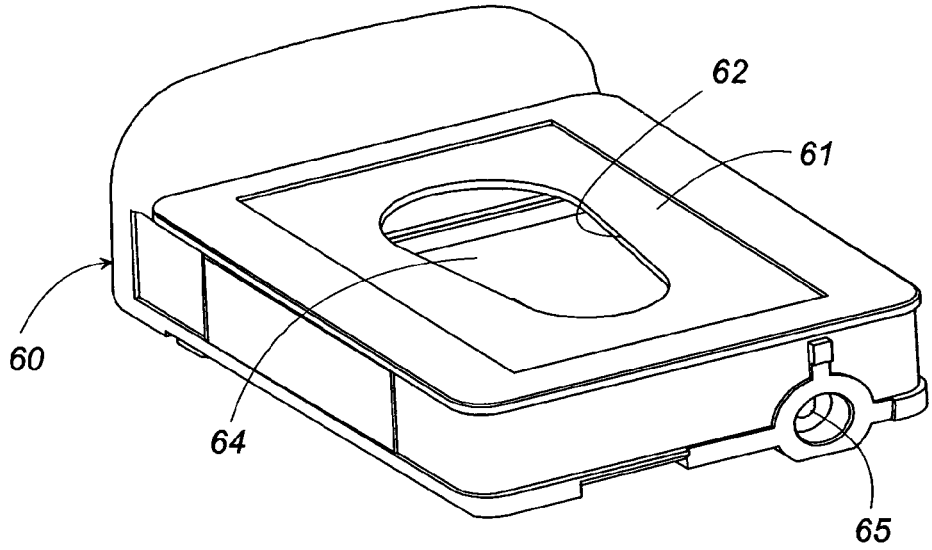
FIG. 4 is a perspective view of a container utilized in the cleaning device.
Figure 5:
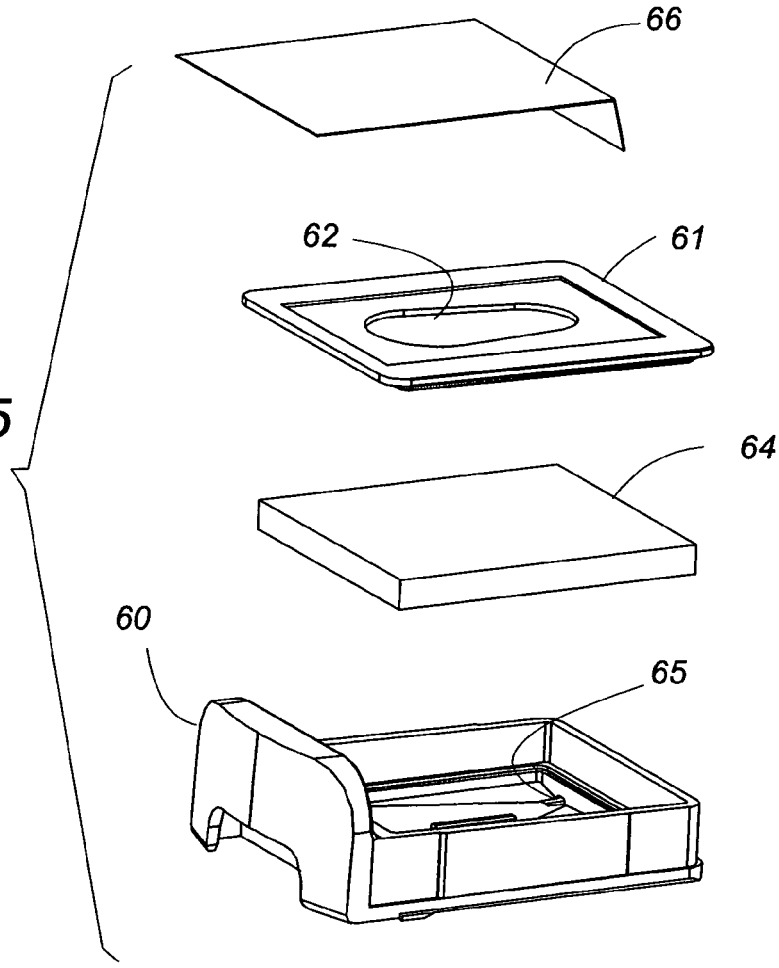
FIG. 5 is an exploded perspective view of the container.

As shown in FIG. 2, a container 60 is disposed immediately below the basin 50 for collecting the liquid dripping and/or overflowing from the basin 50. The container 60 is configured as a removable drawer pan inserted in the front bottom of the housing 20 and is configured to hold the solute which is exposed to the solution or the liquid flowing from the basin 50 to be dissolved therein. As best shown in FIGS. 4 and 5, the container 60 is a top-open rectangular flat box accommodating therein a filter 64 impregnated with the solute. The container 60 includes a lid 61 with a top opening 62 which communicates with a drain port 52 at the bottom center of the basin 50, and also with an overflow duct 54 leading to an upper edge of the basin 50 in order to receive the liquid and/or the solution flowing from the basin 50. The filter 64 is fabricated of fibers into an unwoven fuzzy fabric to soak up the solute as well as to entrap hairs or contaminants dislodged from the shaver head 12 and carried by the liquid dribbling through the drain port 52 towards the container 60. The liquid replenished with the solute and cleared of the contaminants is fed through a connection port 65 in the rear end of the container 60 to a recovery path 22 leading to the tank 80. The container 60 is preferred to be prepared as a replacement package including the filter 64 for easy maintenance of the device. In this case, the top opening 62 is sealed by a release film 66 and the connection port 65 is provided with a valve which is opened only when the container 60 is mounted to the housing 20.

The pump 70 is disposed in the recovery path 22 for drawing the liquid from the basin 50. The recovery path 22 is open to the atmosphere through the drain port 52 and the overflow duct 54. Thus, depending upon the level of the liquid in the basin 50, the outside air is drawn alone or together with the liquid by the action of the pump 70 into the tank 80 through the recovery path 22.

Figure 6:
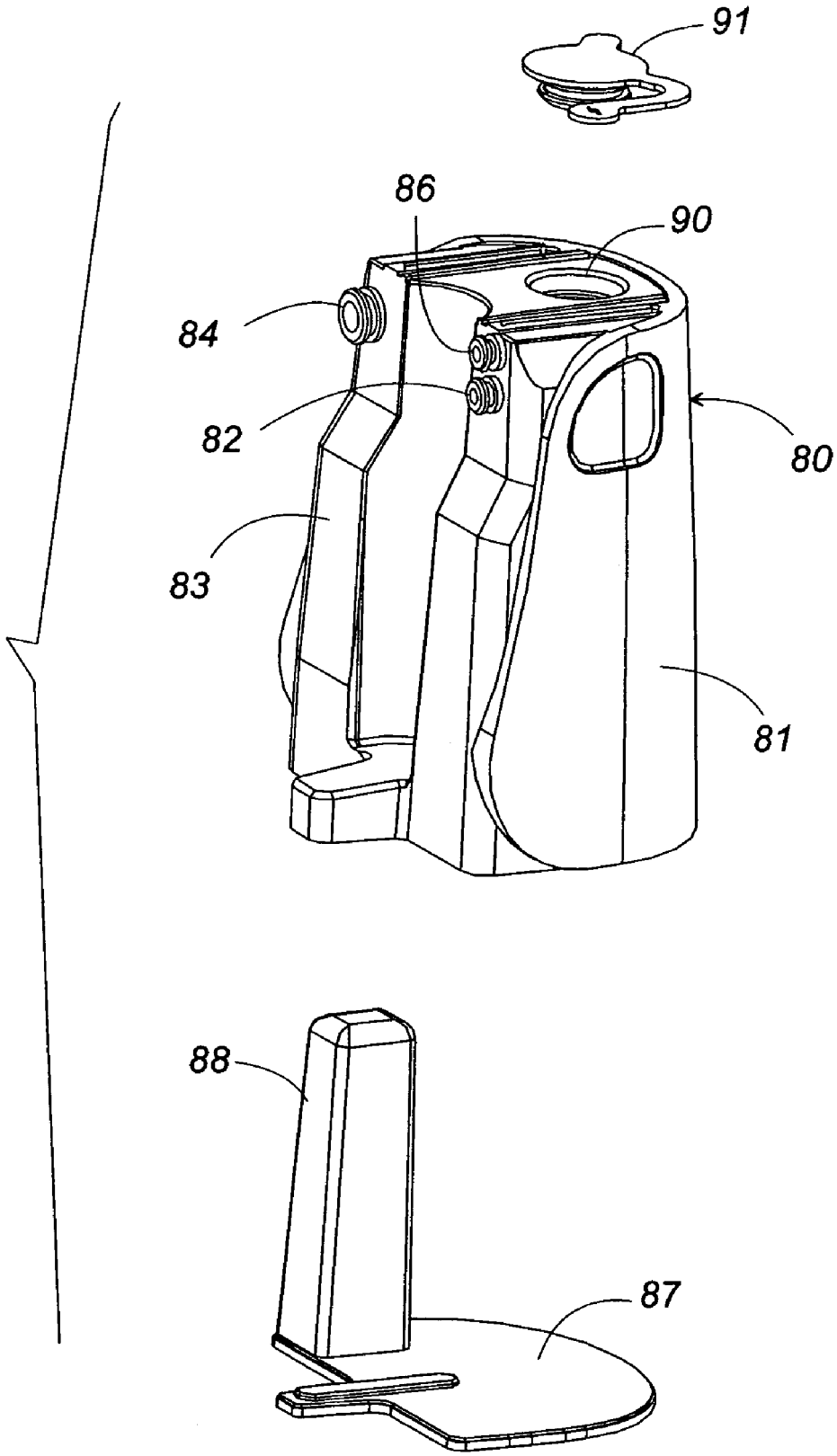
FIG. 6 is an exploded perspective view of a tank utilized in the cleaning device.

As shown in FIGS. 6 and 7, the tank 80 is divided into a hermetically sealed pressure chamber 81 and an open-air liquid dispensing chamber 83 which communicates with each other through a bottom channel 85. A dummy projection 88 projects from a bottom plate 87 of the tank into the liquid dispensing chamber 83 to differentiate capacities of the chambers so that the liquid dispensing chamber 83 is given less capacity than the pressure chamber 81, as schematically shown in FIGS. 7A to 7E. The pressure chamber 81 is provided at its upper end with an inlet 82 connected to the recovery path 22 for receiving the liquid and/or the air. Also provided at the upper end of the pressure chamber 81 is an air vent 86 to selectively open the chamber to the atmosphere. The liquid dispensing chamber 83 is formed at its upper end with an outlet 84 which is connected to a liquid supply path 24 for feeding the liquid out of the tank 80 into the basin 50. The solution is initially stored into the tank 80 through a filling port 90 which is formed at the top of the pressure chamber 81 and is hermetically sealed by a cap 91. When the tank 80 is attached to the housing 20, a knob 44 at a rear extension 42 of the stand 40 presses the cap 91 to keep it closed.

As shown in FIG. 3, a portion of the recovery path 22 leading from the pump 70 to the tank 80 is defined by a tube 92. Likewise, the supply path 24 is defined by a tube 94. The tubes 92 and 94 terminate respectively at ports (not shown) formed on the side of the stand 40 for detachable connection with the inlet 82 and the outlet 84 of the tank 80. An open port (not shown) is provided also on the side of the stand 40 for detachable connection with the air vent 86 for communicating the air vent with the atmosphere. The open port includes a valve 46 which is controlled to open and close the air vent 86 selectively.

Figure 7A:
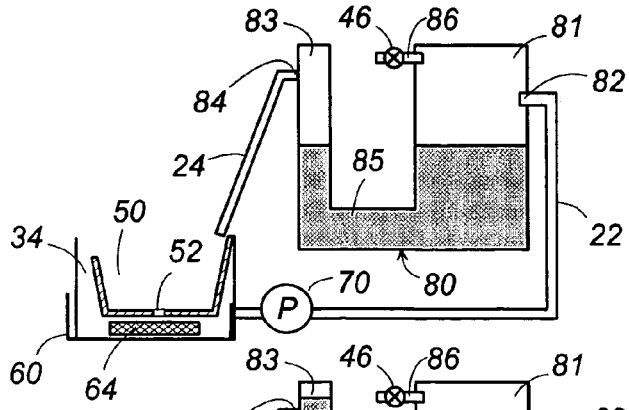
FIGS. 7A to 7E are schematic views illustrating the operation of the cleaning device.
Figure 7B:
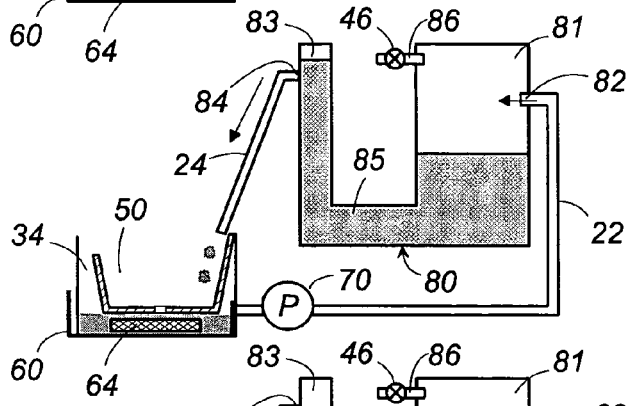
Figure 7C:
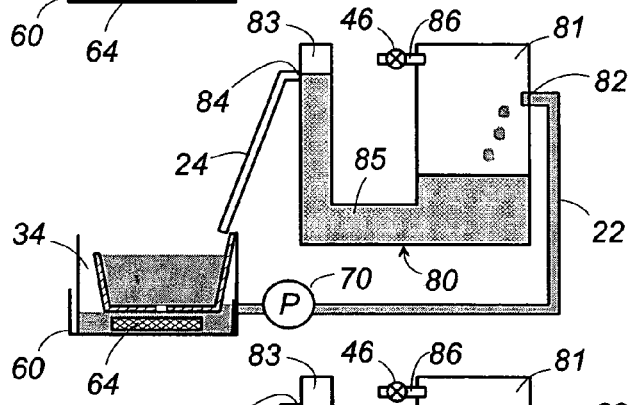
Figure 7D:
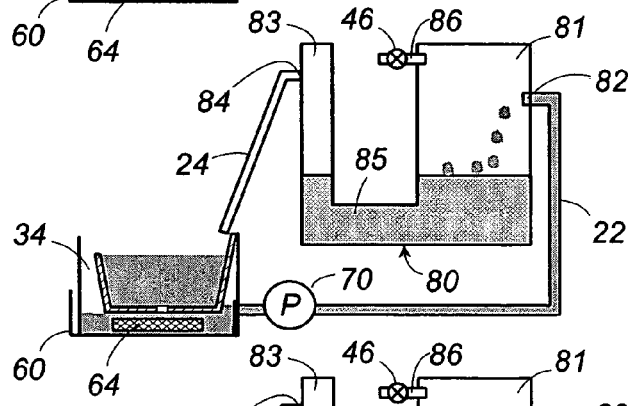
Figure 7E:
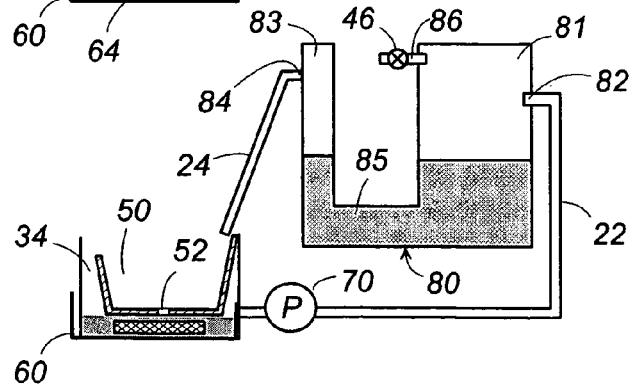

Now, the operation of the device is discussed with reference to FIGS. 7A to 7E. The device includes a controller for control of the pump 70 in combination with the valve 46 of the air vent 86. At a starting condition of FIG. 7A, only the tank 80 is filled with the solution or the cleaning liquid with the air vent 86 being kept open to the atmosphere. When a switch button 26 at the front end of the housing 20 is pressed, the controller activates the pump 70 and at the same time closes the valve 46 to make the pressure chamber 81 hermetically closed. In this condition, the pump 70 draws the outside air through the container 60 and the recovery path 22, building up the air pressure within the chamber 81, which in turn rises the liquid level within the dispensing chamber 83 above the outlet 84, as shown in FIG. 7B. Thus, the liquid begins flowing out of the outlet 84 into the basin 50 through the supply path 24. This continues until the basin 50 is filled with a sufficient amount of the liquid, as shown in FIG. 7C, after which the pump 70 draws the liquid instead of the air to circulate the liquid between the tank 80 and the basin 50 to maintain the liquid level of the basin at a constant level for cleaning the shaver head 12. When the controller acknowledges an elapse of a predetermined time indicative of the cleaning time, it activates the valve 46 to open, thereby lowering the liquid level of the dispensing chamber 83 below the outlet 84 to stop supplying the liquid to basin 50, as shown in FIG. 7D, while the pump 70 continues to draw the liquid from the basin to the tank 80. Upon the basin 50 being made empty after operating the pump 70 for a predetermined time from the opening of the valve 46, the controller stops the pump 70 with the valve 46 kept opened, as shown in FIG. 7E, to terminate the recovery of the liquid. Alternatively, a level sensor may be provided in the basin 50 to give an empty signal when the basin 50 becomes empty so that the controller stops the pump to terminate the recovery mode. Since the air vent 86 is kept opened except during the circulation of the liquid, the liquid level can be kept lower than the outlet 84 so as not to dispense the liquid out of the tank 80 in that condition.

Figure 8:
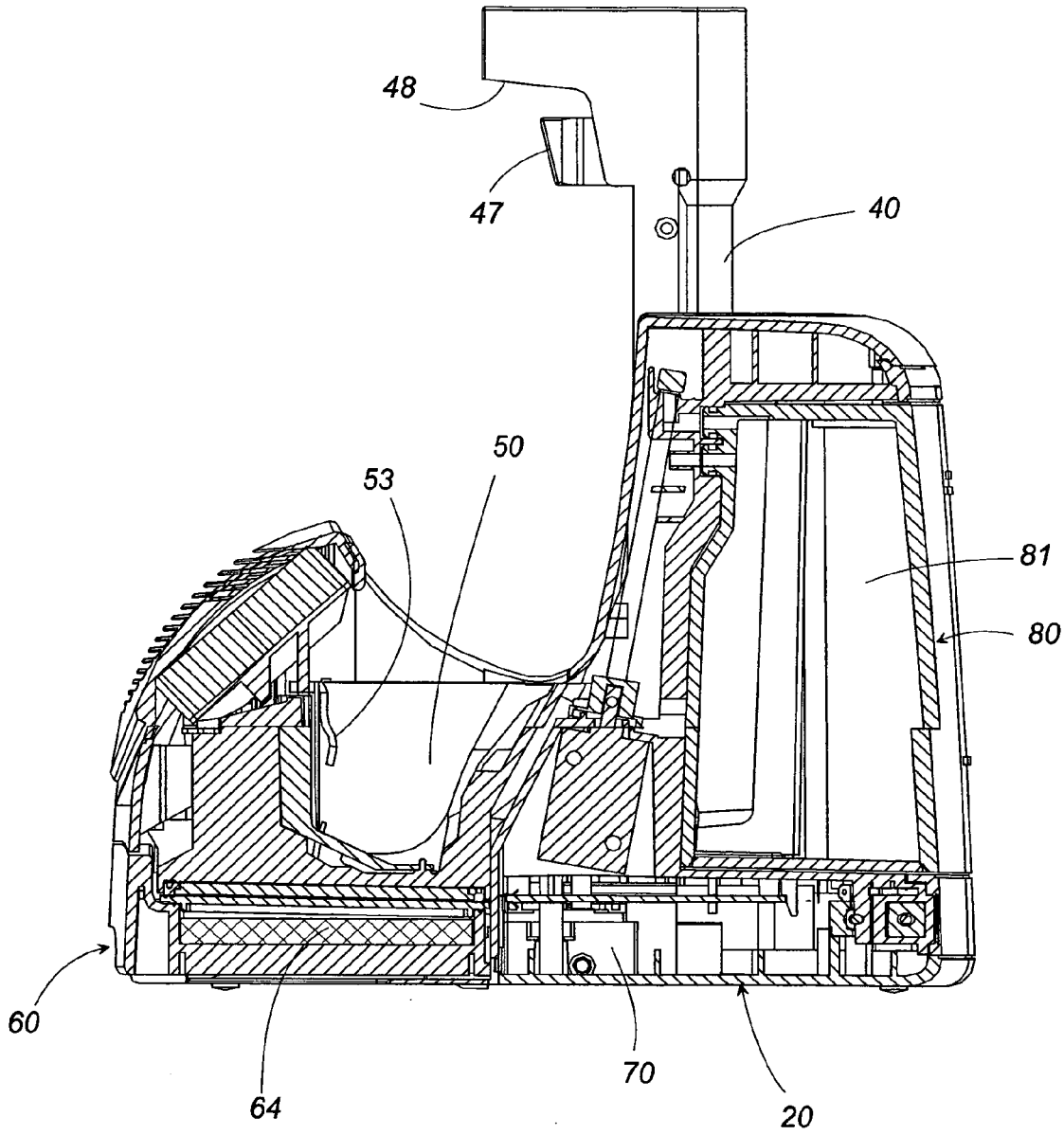
FIG. 8 is a vertical section of the cleaning device with a shaver removed therefrom.
Figure 9:
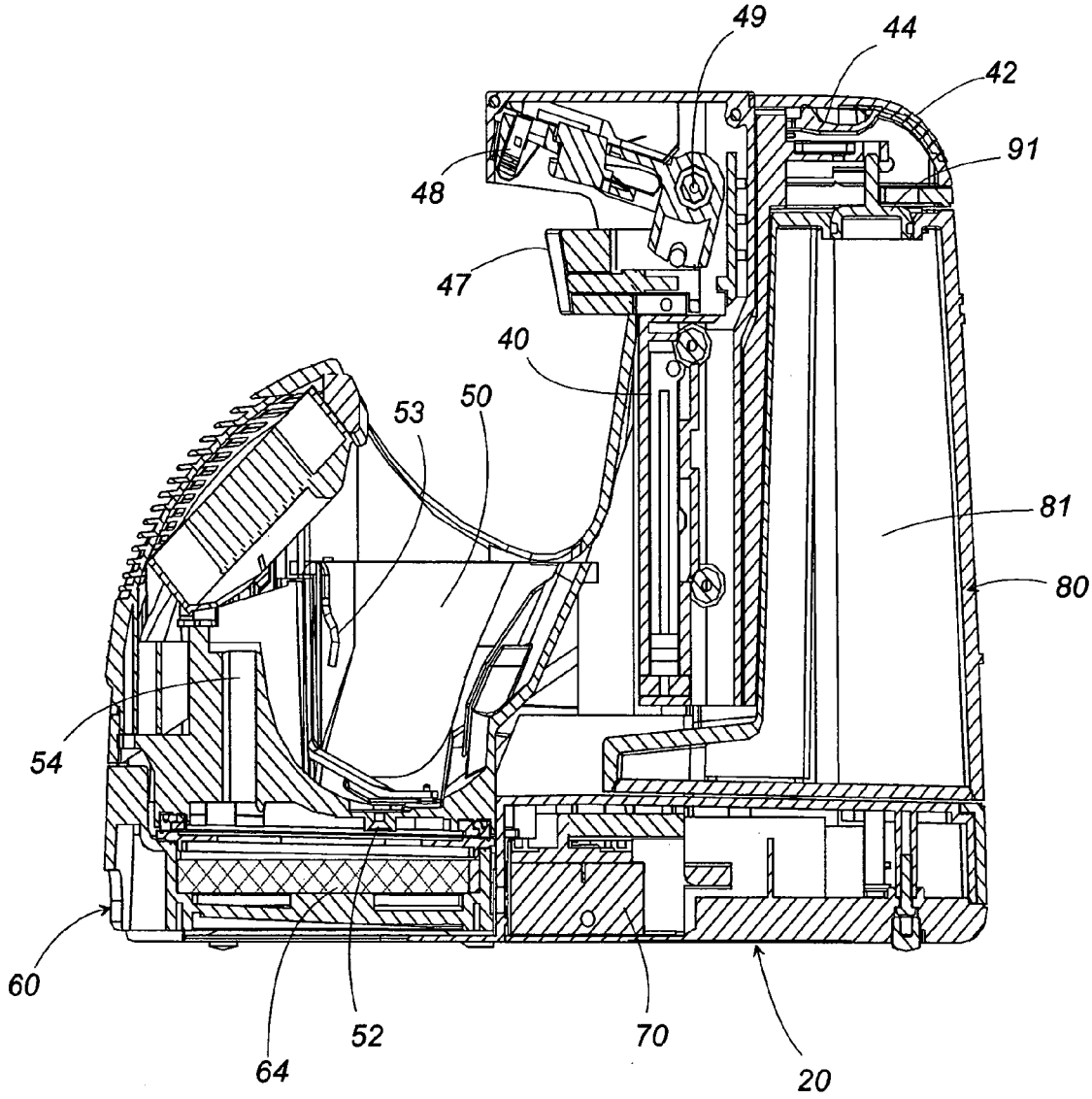
FIG. 9 is a vertical section of the cleaning device with a stand shown in a retracted position.

During the circulation of the liquid, the solute in the container 60 is replenished into the liquid or the solution to give a sufficient concentration of the solute for maximum cleaning effect. It is noted in this connection that the controller is also configured to activate the shaver head intermittently or continuously to shake the contaminations off for enhanced cleaning effect, while the liquid level of the basin 50 is above a predetermined level as monitored by a level sensor 53, as shown in FIG. 8. In this connection, the stand 40 is provided with signal terminals which come into contact with corresponding terminals of the shaver for activating a motor of the shaver. Further, the controller is configured to give a warning on an indicator 28 when the level sensor 53 acknowledges that the basin 50 is not filled with a sufficient amount of the cleaning liquid during the circulation, prompting an user to replace the filter and/or supply the solution in the tank 80.

As shown in FIGS. 2, 3, 8 and 9, the stand 40 carries at its top a catch 48 configured to clasp the lower end of shaver 10 to lock the shaver 10 in position in combination with a grip 47 on the stand 40. The catch 48 is pivotally connected to the upper end of the stand 40 to pivot about a horizontal pin 49 for facilitating to catch and release the shaver. The catch 48 carries, in addition to the above signal thermals, charge terminals for recharging a rechargeable batter of the shaver by a charge current generated from a DC voltage source incorporated in the housing 20. The stand 40 is made retractable from a normal position of holding the shaver as shown in FIG. 8 to a retracted position of FIG. 9 to make the device compact when out of use.

Although the above embodiment illustrates that the container 60 is disposed in the recovery path 22 from the basin 50 to the tank 80, it is equally possible that the container 60 may be disposed in the supply path 24 from the tank 80 to the basin 50 for replenishing the solute in the liquid being supplied to the basin. Further, instead of providing the container itself as the replacement package, the filter 64 impregnated with the solute may be alone provided as a replacement package for the container. Still further, the solute may be impregnated or carried by another element other than the filter 64. Although the tank is made detachable to the housing in the above illustrated embodiment, the tank may be secured to or integrated into the housing 20.

The cleaning device in accordance with the present invention can be equally applied for cleaning the epilating head of a hand-held epilator or other operator head of similar hair removing apparatus.

The invention claimed is:

1. A cleaning device for a hair removing apparatus, said device comprising:

a housing configured to hold said hair removing apparatus;

a basin configured to be mounted in said housing for receiving therein an operator head of said apparatus;

a cleaning liquid composed of a solvent and a solute dissolved therein;

a tank provided in the housing and configured to store said cleaning liquid;

a circulator configured to supply said cleaning liquid to said basin from said tank for cleaning the operator head and to recover the liquid from the basin back into said tank;

wherein said device includes a container formed separately from said tank and mounted to said housing, said container being disposed in a circulation path between said basin and said tank in order to replenish the solute into the solvent circulating between the basin and the tank, said container being disposed immediately downstream of said basin within said circulation path, said container being configured to hold said solute to replenish said solute in the cleaning liquid being recovered from said basin to said tank and, said container being provided with a filter for trapping a dirt included in the cleaning liquid being recovered from said basin to said tank.

2. The cleaning device as set forth in claim 1, wherein said container is detachable to said housing.

3. The cleaning device as set forth in claim 1, wherein said filter is made of fibers into a frizzy fabric.

4. The cleaning device as set forth in claim 1, wherein said filter is impregnated with said solute.

5. The cleaning device as set forth in claim 1, wherein said solvent includes at least one selected from a group consisting of water and alcohol.

6. The cleaning device as set forth in claim 1, wherein said solute includes at least one selected from a group consisting of a surfactant, a sanitizer, antifoaming agent, and a lubricant.

7. The cleaning device as set forth in claim 1, wherein said circulator includes a pump for feeding said cleaning liquid and/or the outside air into said tank from said basin, said tank being composed of a hermetically sealed pressure chamber and an open-air liquid dispensing chamber, said pressure chamber having an inlet for introducing the liquid and/or the air from said basin, said liquid dispensing chamber having an outlet for dispensing the liquid out of said tank into said basin, said pressure chamber and said liquid dispensing chamber communicating with each other through a bottom channel at a level lower than said outlet such that the air introduced into said pressure chamber is accumulated therein to raise the liquid level of said liquid dispensing chamber above said outlet for feeding the liquid out of said tank into said basin.

* * * * *